US007350838B2

(12) United States Patent
Schlattl et al.

(10) Patent No.: US 7,350,838 B2
(45) Date of Patent: Apr. 1, 2008

(54) CATCH OR LOCKING ELEMENT

(76) Inventors: Alice Schlattl, Osserstrasse 1, 94162 Ruderting (DE); Ralph Schlattl, Osserstrasse 1, 94162 Ruderting (DE)

( * ) Notice: Subject to any disclaimer, the term of this patent is extended or adjusted under 35 U.S.C. 154(b) by 125 days.

(21) Appl. No.: 10/510,709

(22) PCT Filed: Feb. 14, 2003

(86) PCT No.: PCT/DE03/00456

§ 371 (c)(1),
(2), (4) Date: Oct. 15, 2004

(87) PCT Pub. No.: WO03/069101

PCT Pub. Date: Aug. 21, 2003

(65) Prior Publication Data

US 2005/0200138 A1 Sep. 15, 2005

(30) Foreign Application Priority Data

Feb. 14, 2002 (DE) ..... 202 02 337 U

(51) Int. Cl.
*E05C 19/00* (2006.01)

(52) U.S. Cl. ..... 292/302; 292/DIG. 60; 292/DIG. 61

(58) Field of Classification Search ..... 292/302, 292/129, DIG. 60 X, DIG. 61 X, 341.18, 292/DIG. 38, 175, 162
See application file for complete search history.

(56) References Cited

U.S. PATENT DOCUMENTS

| | | | | |
|---|---|---|---|---|
| 3,115,358 | A | 12/1963 | Bugge | |
| 3,761,027 | A * | 9/1973 | Mendoza | 241/261.3 |
| 4,660,871 | A * | 4/1987 | Arakawa et al. | 292/81 |
| 4,792,165 | A * | 12/1988 | Nishimura | 292/19 |
| 5,409,272 | A * | 4/1995 | McCormack | 292/66 |
| 5,593,192 | A * | 1/1997 | Stuchinsky | 292/207 |
| 5,765,883 | A * | 6/1998 | Dessenberger et al. | 292/92 |
| 5,897,147 | A * | 4/1999 | Alyanakian et al. | 292/175 |
| 6,151,754 | A | 11/2000 | Chen | |
| 6,499,185 | B1 * | 12/2002 | Moyer et al. | 16/51 |
| 6,513,841 | B1 * | 2/2003 | Jackson | 292/214 |

FOREIGN PATENT DOCUMENTS

| | | |
|---|---|---|
| DE | 19 93 392 | 7/1968 |
| DE | 74 41 379 | 12/1974 |
| EP | 0 728 888 | 8/1996 |
| EP | 0 798 439 | 10/1997 |
| FR | 2 451 986 | 10/1980 |

* cited by examiner

*Primary Examiner*—Patricia Engle
*Assistant Examiner*—Mark Williams
(74) *Attorney, Agent, or Firm*—Hoffman, Wasson & Gitler, P.C.

(57) ABSTRACT

The invention relates to a catch, in particular a catch for furniture. Said catch comprises at least one first catch element, which has at least one spring-loaded locking part and a second catch element that forms a counter-locking part. According to the invention, the elastic force of the spring-loaded locking part can be adjusted manually without tools.

9 Claims, 4 Drawing Sheets

FIG.7
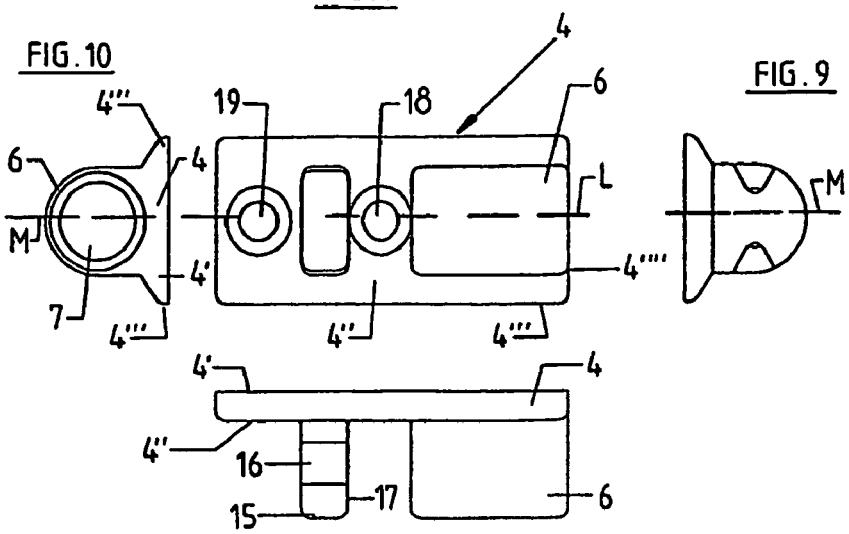
FIG.10
FIG.9
FIG.8
FIG.14
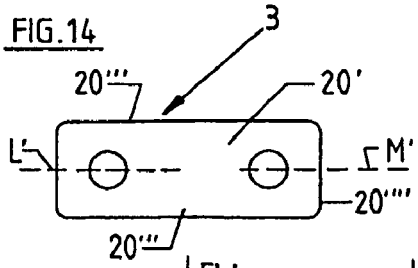
FIG.11
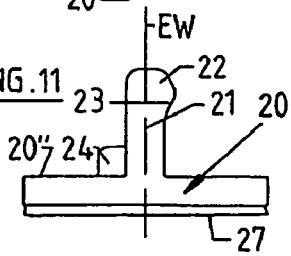
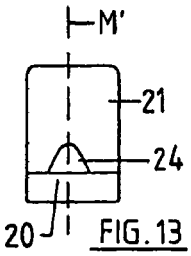
FIG.13
FIG.15
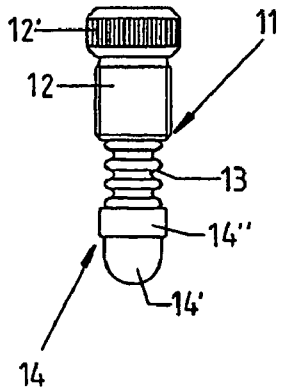
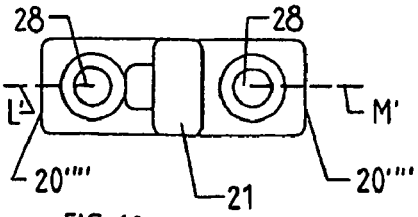
FIG.12

CATCH OR LOCKING ELEMENT

The latch according to the invention is intended especially for use in furniture of various types and especially for use with furniture doors, hinged flaps, etc. and also for drawers in furniture. The latch according to the invention generally can also be used for other flaps, leafs, covers or shutters that are removably fastened by latching.

The object of the invention is to present a latch that is inexpensive to manufacture while featuring optimum functionality.

The latch according to the invention or its latch elements are preferably made of plastic, including the catch element forming the spring-mounted catch and the corresponding spring means. Manufacturing the latch according to the invention from plastic makes it resistant to chemicals, such as cleaning agents, caustic solutions, powdered substances, etc. It is corrosion-resistant, which makes it especially suitable for use in wet areas.

A special feature of the latch according to the invention is the fact that the latching force can be manually adjusted without using tools, preferably continuously adjustable, so that the latching force can easily be set or adjusted for individual applications. Generally it is also possible, however, that the latching force be adjustable in several predefined stages.

In a preferred embodiment of the invention the latch consists essentially of only three components manufactured from plastic as injection molded parts, namely of the second latch element forming the counter latch, and of the first latch element, and of the catch element forming the spring-mounted catch, which is also manufactured from plastic by means of injection molding, including the spring means, which are formed from a section made of an elastomer plastic, while especially the latch that works together with the counter latch is made from a catch element section made of a plastic that is resistant to wear and has low elasticity. The catch element is preferably manufactured with a third catch element section, which is used to adjust the spring force and likewise is manufactured from the plastic with low elasticity. The parts are manufactured for example by injection molding of the various sections or by using an in-mold process.

In a preferred embodiment, the first latch element located opposite of the spring-mounted catch forms a counter bearing surface or a support element for the counter catch, so as to ensure that the hinges or flap or leaf are fully relieved of tension upon latching, so that there is no danger of damage to the respective flap or door or danger of the hinges pulling out.

The counter catch is for example formed from a wall section of the second latch element and comprises, for example, two adjacent beveled surfaces that work together with the spring-mounted catch with a gradient resulting in a steeper opening gradient with respect to the opening and closing force of the latch or of a flap or door equipped with this latch, in addition to pleasant and soft closing characteristics due to a considerably longer and flatter closing gradient.

In a preferred embodiment of the invention, in addition to the spring-mounted catch and the counter catch, means are provided that interlock with each other when the latch elements are latched together and in particular that define a specific position of the two latch elements relative to each other. These means are for example formed by a tapered peg or projection on one latch element and a matching recess on the other latch element.

Furthermore, the latch elements of the latch according to the invention are preferably designed so that the latch and its elements can easily be mounted in the correct position on the body and corresponding flap or door of a piece of furniture, especially also by non-professionals. For this purpose, the latch elements are formed so that in latched position the surface sides used for fastening lie in planes that form a right angle with each other, whereby one long side of e.g. the first latch element is also located in the intersection of these planes and serves as a reference edge during mounting.

At least one of the two latch elements, preferably at least the second latch element, is designed with a self-adhesive fastening surface, so that after mounting of the first latch element and when the first and second latch elements are engaged with each other, the second latch element adheres to the flap or door leaf in the correct position by closing the flap or door.

The invention is described in detail below based on an exemplary embodiment with reference to the drawings, wherein:

FIG. 7-10 show the active latch element with the spring-mounted catch in views corresponding to FIGS. 1-4;

FIG. 11-14 show the passive latch element with the counter catch in side view, top view, front view and rear view;

FIG. 15 shows a single representation of the catch element forming the catch;

Figure 5:
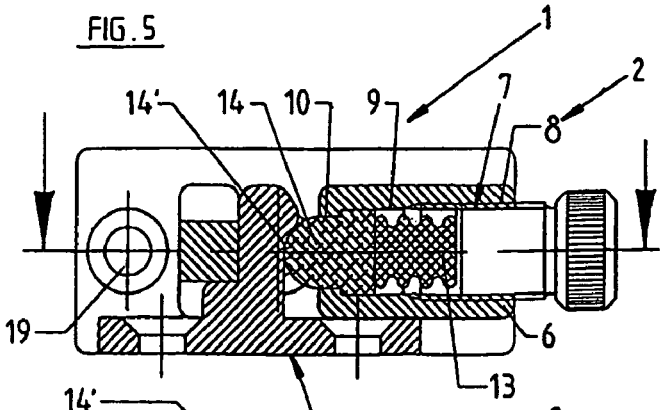
FIGS. 5 and 6 show representations similar to FIGS. 1 and 2, however both in longitudinal sections.
Figure 6:
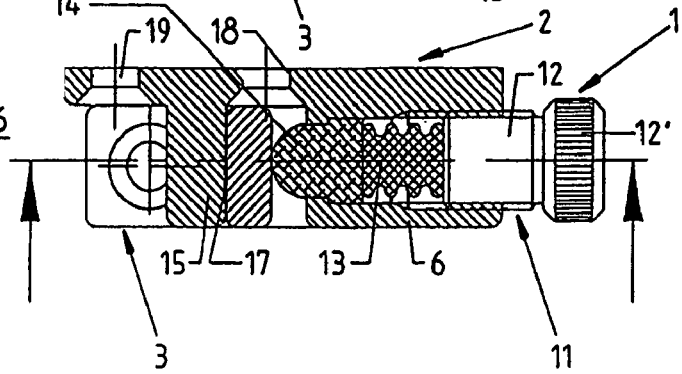

The latch generally designated 1 in the drawings consists essentially of one active latch element 2 and one passive latch element 3. Both elements are made of plastic in the depicted embodiment, preferably of a plastic that is safe for use with food.

The latch element 2 comprises a mounting plate 4 that is rectangular in top view and has a flat bottom 4' and a top 4" and is beveled on its two long sides 4''' extending parallel to the longitudinal axis L of the latch element 2 on the top side 4" at 5. On the top 4" of the mounting plate 4, which is symmetrical to a middle plane M enclosing the longitudinal axis L and extending perpendicular to the bottom 4', a sleeve-like housing section 6 is molded on that lies with its sleeve axis in the middle plane M and parallel to the plane of the bottom 4', and beginning with one end 4'''' of the mounting plate 4 extends over a partial length of this mounting plate, in the depicted embodiment approximately over half the length of the mounting plate 4. The aperture 7 of the sleeve-like housing section 6 is provided with inner threads on a partial length or section 8 beginning from the end of the mounting plate 4. The section 9, on which the aperture 7 has a cylindrical cross section, connects to this section 8. On the end facing away from the end 4''' of the mounting plate 4 the aperture 7 forms a section 10, which has a circular cross section, but with a diameter somewhat smaller than the diameter of the section 9. The housing section 6 is formed so that it forms a cylindrical surface on the axis of the aperture 7 on its top side facing away from the mounting plate 4, whereby this cylindrical section extends over an angle area of approximately 180°. On both long sides the outer surface of the housing section 6 crosses over into a wall section that is parallel to the axis of the aperture 7 and perpendicular to the plane of the mounting plate 4. The width of the housing section 6 perpendicular to the middle plane M is such that the housing section 6 crosses over into the top 4" of the mounting plate 4 at the point where the top 4" connects to the respective beveled surface 5.

The housing section 6 is used to hold a catch element generally designated 11 in the drawings, which in the depicted embodiment has three catch element sections 12, 13 and 14, of which the section 12 is provided with outer threads, which mesh with the inner threads of the housing section 8, such that when the catch element 11 is present in the housing section 6, the catch element section 12 with a knurled adjusting cap 12' protrudes over the end of the housing section adjacent to the one narrow side 4"" of the mounting plate 4. The catch element 11, which on its free end, i.e. the end facing away from the catch element section 12, forms a hemispherical catch 14', can be moved axially with a cylindrical section 14" in the aperture section 10, such that the catch 14' protrudes over the side of the housing section 6 facing away from the narrow side 4'" and out of this housing section and when the two latch elements 2 and 3 are not engaged with each other bears with a collar formed on the catch element section 14 against the collar formed in the aperture 7 between the aperture sections 9 and 10.

The catch element section 13 is accommodated in the aperture 7 between the catch element section 12 and the catch element section 14. The catch element sections 12 and 14 are made of a plastic with high stability and reduced elasticity. The section 13 is formed from an elastomer plastic, so that this section, which is provided on its outer surface with a plurality of ring-shaped recesses, functions as a spring. The catch element 11 is preferably manufactured with its sections 12, 13 and 14 by means of molding or injection molding using the in-mold process. By turning the cap piece 12' the tension of the catch element section 13 functioning as a spring element and therefore the spring force of the spring-mounted catch 14' can be adjusted continuously by hand and without the use of a special tool.

Opposite the side of the housing section 6 facing away from the one narrow side 4"" and at a distance from this side, a counter bearing surface is formed on the top 4" of the mounting plate 4, which (counter bearing surface) in the depicted embodiment is formed by a wall section 15, which in its outer contour corresponds to the outer cross section of the housing section 6, i.e. the outside circumference of the wall section 15 is formed by a cylindrical surface on the axis of the aperture 7 forming the free end of this wall section, which (cylindrical surface) extends over an angle area of 180° and then on both sides crosses over into a section that extends parallel to this longitudinal axis and perpendicular to the plane of the mounting plate 4.

On this outer contour, the wall section 15 is provided on each of two opposing sides with a V-shaped groove or recess 16. The two recesses 16 lie with their middle axis in a common plane extending parallel to the bottom 4' that encloses the longitudinal axis of the aperture 7 and is perpendicular to the middle plane M. On the side facing the housing section 6, the wall section 16 forms a bearing or opposing surface 17, which is flat and lies in a plane perpendicular to the longitudinal axis L and the middle plane M.

In the space between the bearing surface 17 and the end side of the wall section 6 opposing this surface, the mounting plate 4 is provided with a hole 18 for mounting the latch element 2. A corresponding hole 19 is located on the mounting plate 4 between the wall section 15 and the narrow side 4"". Both mounting holes 18 and 19 lie with their axes in the middle plane M.

The passive latch element 3 consists essentially of a rectangular base or mounting plate 20 with a bottom 20', a top 20", two long sides 20'" and two narrow sides 20"". The latch element 3 is likewise symmetrical to a middle plane enclosing the longitudinal axis L' of this element and located perpendicular to the plane of the bottom 20'. A wall section 21 forming a counter catch is molded onto the top 20", in the depicted embodiment approximately in the middle between the two narrow sides 20"". The wall section 21 ends with each of its narrow sides at a long side 20'" and lies with its larger surface sides in planes perpendicular to the middle plane M. On one side, the wall section 21 forms the counter catch or a counter catch or catch projection protruding over the plane of this side of the wall section 21 and is provided for this purpose with a beveled surface 22, which begins with the free end of the wall section 21 and lies in a plane that forms, with the plane EW of the wall section 21, an angle smaller than 90° that opens toward the mounting plate 20. EW in FIGS. 11 and 12 refers to the plane of the wall section to which the two larger surface sides of the wall section 21 are parallel and which intersect the middle plane M' perpendicularly.

The beveled surface 22 (closing gradient) is connected with a somewhat steeper beveled surface 23 (opening gradient), which lies in a plane that likewise with the plane EW forms an angle smaller than 90°, which however opens toward the side facing away from the mounting plate 20.

On the side of the wall section 20 facing away from the counter catch formed by the beveled surfaces 22 and 23, in the area of the crossover between this wall-section and the mounting plate there is a projection on top of the mounting plate 20 that in the depicted embodiment has a tapered V-shaped cross section in a plane perpendicular to the middle plane M.

Figure 3:
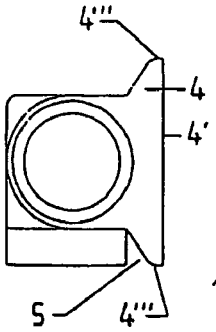
FIG. 1-4 show the latch according to the invention in various views.
Figure 1:
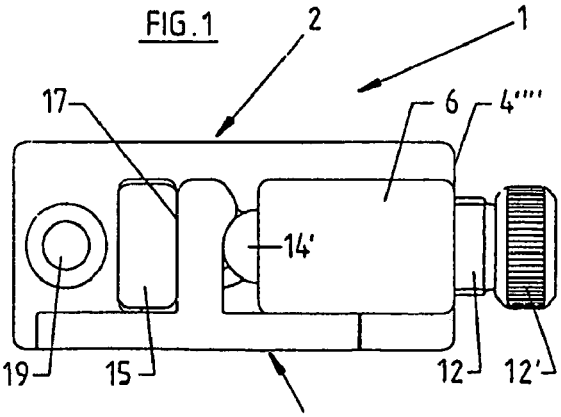
Figure 4:
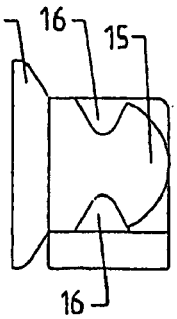
Figure 2:
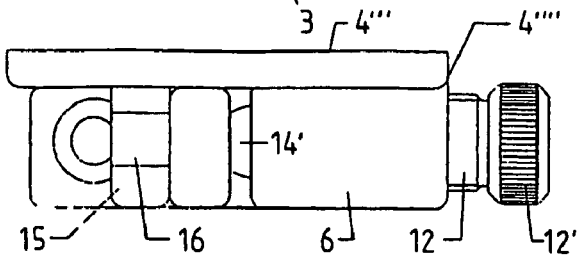

The wall section 21 is designed so that it can be inserted in the gap between the bearing surface 17 and the spring-mounted catch 14' projecting over the housing section 6, such that this catch 14' first slides on the beveled surface 22 and then catches on the beveled surface 23, in an axis direction-radial to the axis of the housing section 6. The design is such that the distance between that area of the beveled surface 23 on which the spring-mounted catch 14' bears when latched into place and the top 20" is equal or approximately equal to the radius of the curved top of the housing section 6 and also approximately equal to the distance between the axis of the aperture 7 and the top 4" of the mounting plate 4. When latched into place, the projection 24 engages in one of the grooves 16, so that the bottom 20' or top 20" of the mounting plate 20 lies in a plane perpendicular to the plane of the bottom 4' of the mounting plate 4, namely in a plane in which also the long edge of the bottom 4' is located (see FIG. 3). This design makes it possible to use the respective long edge 4'" of the bottom 4' of the mounting plate 4 as a reference edge when mounting the latch 1.

Figure 16:
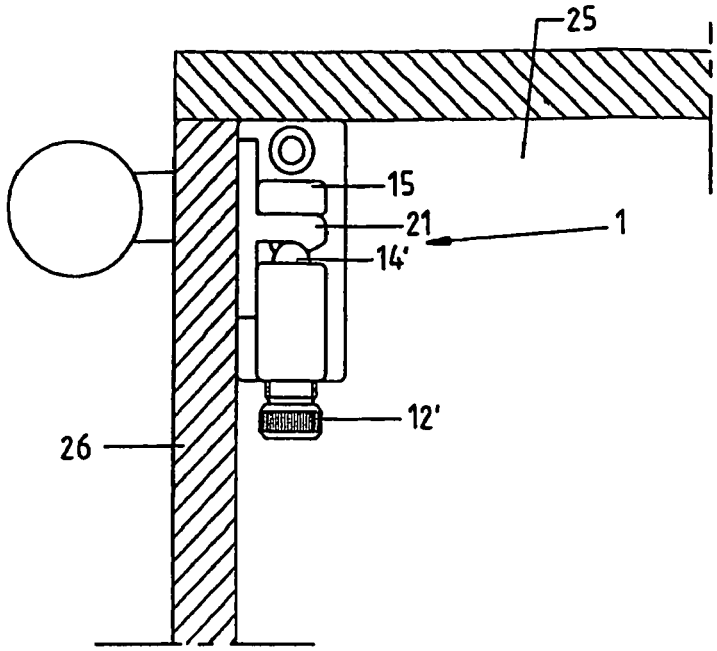
FIGS. 16 and 17 show a sample mounting of the latches on a hinged furniture door with the door in closed position and in open position.
Figure 17:
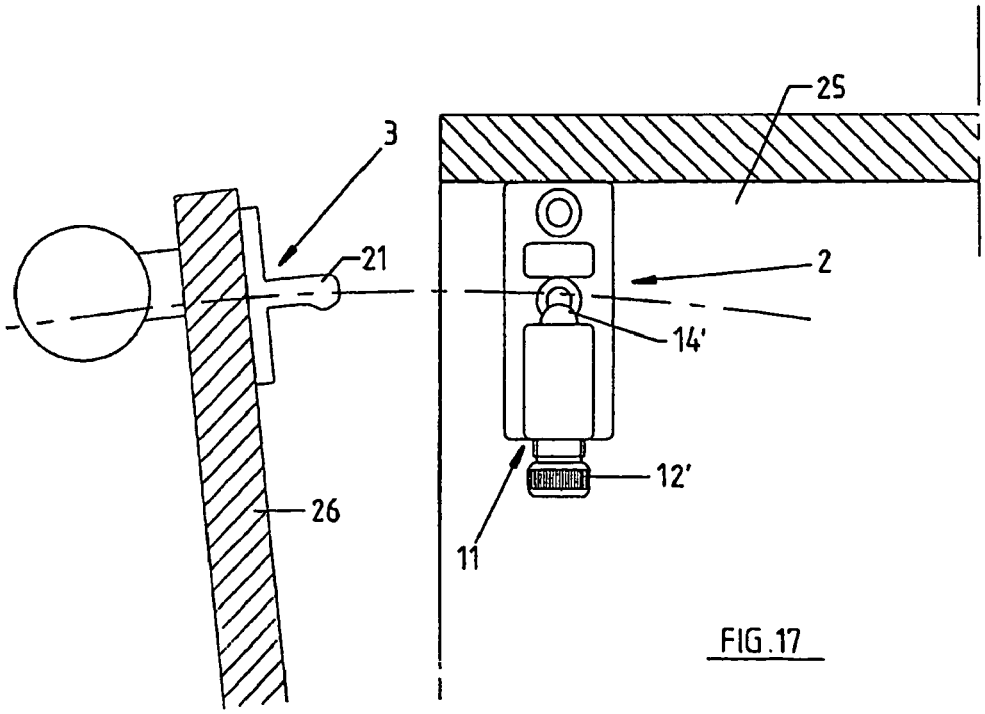

FIGS. 16 and 17 show the mounting of the latch 1 on a furniture body 25 with a hinged door 26, whereby the door 26 is a door that swivels into the body in closed position. The latch element 2 is mounted with its mounting plate 4 on the body 25 with the screws passing through the holes 18 and 19 so that when the door is closed one of the long edges 4'" bears against the inside of the closed door 26. The latch element 3 is mounted on the inside of the door 26 so that it engages with the latch element 2 when the door is closed. To simplify the exact positioning of the latch element 3 on the door 26 during mounting, the holding plate 20 is self-adhesive on its bottom 20', for example it is provided with a double-sided adhesive tape 27. Mounting takes place as follows: first, the latch element 2 is mounted on the body 25 and the latch element 3 is fastened to the latch element 2 by snapping into place, while the door 26 is still open, so that the self-adhesive tape layer 27 is exposed at the non-closed door aperture. By turning the cap 12', the catch element 11 is adjusted so that its spring force is minimal. Afterwards, the door 26 is closed, so that the inside of the door comes to bear against the adhesive layer 27, causing the latch element 3 to be held in the correct position on the inside of the door 26 by adhesion, also after the door 26 is opened again. Screws that pass through the mounting holes 28 in the mounting plate 20 are used for final fastening of the latch element 3 to the inside of the door 26. The required latch force is then adjusted by turning the cap 12'.

The advantages of the described latch 1 are, for example, that the latch elements 2 and 3 and the catch element 11 can be manufactured inexpensively from plastic as injection molded parts, also in a visually appealing form, that the sliding of the counter catch 21 on the wall section 16 enables the latch elements 2 and 3 to latch into place without additional strain on hinges of a hinged door or flap, for example the furniture door 26, and that also in latched condition of the latch elements 2 and 3, the exact position of the latch elements 2 and 3 is ensured by the projection 24 engaging in a groove or recess 16, especially during the mounting of the latch element 2 to a door or flap as described above.

The latching force can be adjusted manually and without using tools. Due to the symmetrical design of the latch elements 2 and 3, the latch can be mounted in at least two different positions, so that the latching of the latch element 3 on the latch element 2 relative to the middle plane M is possible from either side of this middle plane.

Figure 18:
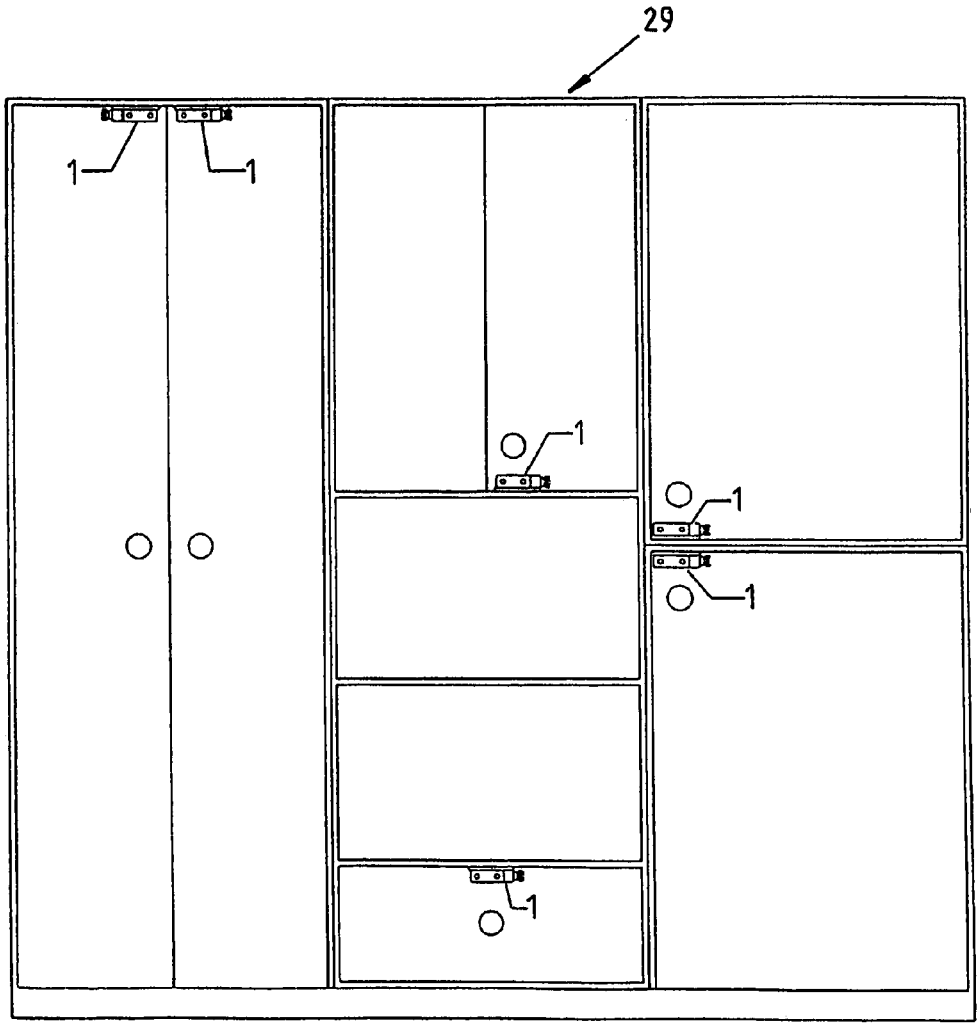
FIG. 18 shows a simplified representation of a cabinet with various examples for installing the latch according to the invention.

FIG. 18 again shows a furniture cabinet in front view with the furniture body 25 and a plurality of doors or leafs 26. As depicted, the latch 1 can be mounted in a wide variety of ways.

REFERENCE SYMBOLS

1 latch
2, 3 latch element
4 fastening plate
4' bottom of fastening plate
4" top of fastening plate
4'" long side of fastening plate
4"" end side of fastening plate
5 beveled surface
6 housing section
7 aperture
8,9,10 aperture section
11 catch element
12 threaded section
12' handle or cap piece
13 spring-mounted section of catch element
14 catch element section
14' spring-mounted catch
14" guide or cylinder piece
15 wall section
16 groove or recess
17 bearing surface
18, 19 fastening hole
20 fastening plate
20' bottom of plate
20" top of plate
20'" long side
20"" end side
21 wall section
22,23 beveled edges
24 projection
25 furniture body
26 furniture door or leaf
27 self-adhesive layer
28 mounting hole
29 cabinet
EW wall section plane
L, L' longitudinal axis
M, M' middle plane

The invention claimed is:

1. A latch comprising at least one first latch element having at least one catch, the catch being a spring-mounted or spring-loaded catch, the catch comprising a first catch element section of a catch element, and a second catch element section made of an elastomer plastic and functioning as a spring for spring loading the catch, a third catch element, said at least one second catch element section located between the first and third catch element sections and being axially adjustable in a housing section of the first latch element for adjusting the spring force of the spring-loaded catch, a second latch element forming a counter catch, and a support for the counter catch formed on the first latch element opposite from the spring-mounted catch wherein the counter catch is received in a space between the spring-mounted catch and the support when the first and second latch elements are latched into place wherein the first latch element comprises a rectangular mounting plate and a housing section on top of the mounting plate for accommodating the catch element and a further wall section forming the bearing.

2. The latch according to claim 1, wherein the spring force of the spring-mounted catch can be adjusted manually and without tools.

3. The latch according to claim 1, wherein the catch element and its sections are manufactured from plastic by means of injection molding.

4. The latch according to claim 3, wherein the catch element and its sections are manufactured from different plastic materials by means of molding and/or injection molding using the in-mold process.

5. The latch according to claim 1, further comprising elements formed on the latch elements interlock with a positive fit when the first and second latch elements are latched into place.

6. The latch according to claim 5, wherein the elements are formed from at least one projection on one latch element and a matching recess on the other latch element.

7. The latch according to claim 1, wherein the second latch element comprises a rectangular mounting plate and a wall section on top of the mounting plate protruding over this top and forming the counter catch.

8. The catch element according to claim 1 wherein the catch element and its sections are manufactured from plastic by means of injection molding.

9. The catch element according to claim 8, wherein the catch element and its sections are manufactured from different plastic materials by means of molding and/or injection molding using the in-mold process.

* * * * *